US007433617B2

(12) United States Patent
Sheen

(10) Patent No.: US 7,433,617 B2
(45) Date of Patent: Oct. 7, 2008

(54) IMAGE FORMING APPARATUS TO CONTROL VOLTAGE OF DEVELOPMENT UNIT

(75) Inventor: So-won Sheen, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 89 days.

(21) Appl. No.: 11/476,753

(22) Filed: Jun. 29, 2006

(65) Prior Publication Data

US 2007/0009272 A1 Jan. 11, 2007

(30) Foreign Application Priority Data

Jul. 8, 2005 (KR) ..... 10-2005-0061783

(51) Int. Cl.
*G03G 15/06* (2006.01)

(52) U.S. Cl. ..... 399/55

(58) Field of Classification Search ..... 399/55, 399/98, 149, 232, 234, 235; 430/45.31
See application file for complete search history.

(56) References Cited

U.S. PATENT DOCUMENTS 5,678,130 A * 10/1997 Enomoto et al. ..... 399/55
6,061,534 A * 5/2000 Okada et al. ..... 399/55 X
6,459,862 B1 * 10/2002 Sakemi et al. ..... 399/55
6,487,384 B2 * 11/2002 Okada et al. ..... 399/232

FOREIGN PATENT DOCUMENTS

| | | |
|---|---|---|
| JP | 11-174788 | 7/1999 |
| JP | 2000-250336 | 9/2000 |
| JP | 2001-350385 | 12/2001 |
| KR | 2001-85251 | 9/2001 |

* cited by examiner

*Primary Examiner*—Sandra L Brase
(74) *Attorney, Agent, or Firm*—Stanzione & Kim, LLP

(57) ABSTRACT

An image forming apparatus includes a plurality of developing units to form a color image using at least a two pass developing process by developing electrostatic latent image with toners having different colors and polarities when performing a first pass of the developing process, and an exposing unit to form a tri-level potential on a photosensitive medium, in which a development applied voltage applied to a second developing unit among a first developing unit and second developing unit of the plurality of developing units operating during the first pass of the developing process is divided into a development voltage Vd, a collection voltage Vc, and at least one intermediate voltage Vn. The intermediate voltage Vn is selectively applied to one of the developing unit during a development voltage Vd applied time during which the second development voltage Vd is applied to the developing unit and during a collection voltage Vc applied time during which the collection voltage Vc is applied to the second developing unit to control one of the development voltage applied time and the collection voltage applied time without changing the other one of the development voltage applied time and the collection voltage applied time.

45 Claims, 6 Drawing Sheets

IMAGE FORMING APPARATUS TO CONTROL VOLTAGE OF DEVELOPMENT UNIT

CROSS-REFERENCE TO RELATED APPLICATIONS

This application claims priority under 35 U.S.C. §119(e) from Korean Patent Application No. 10-2005-0061783, filed on Jul. 8, 2005, in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus to prevent cross contamination by controlling a development voltage of a developing unit.

2. Description of the Related Art

In general, an electrophotographic image forming apparatus produces a desired color image by receiving a digital image signal corresponding to the image and forming an electrostatic latent image on a photosensitive medium using an exposing unit, such as a laser scanning unit (LSU), developing the electrostatic latent image into a toner image using toner, transferring the toner image to a recording medium, and fusing the toner image onto the recording medium by applying heat and pressure thereto.

Toner colors used in a color image forming apparatus are yellow (Y), magenta (M), cyan (C), and black (K). Therefore, the color image forming apparatus requires four developing units to attach the four color toners onto an electrostatic latent image.

A color image forming apparatus can be classified as a single-pass type in which four exposing units and four photosensitive media are included, and a multi-pass type in which a single exposing unit and a single photosensitive medium are included.

The single-pass type color image forming apparatus is generally used as a high-speed image forming apparatus since the time required for color printing is the same as the time required for monochrome printing. However, the single-pass type color image forming apparatus is costly and difficult to miniaturize because the apparatus includes the four exposing units and the four photosensitive media.

The multi-pass type color image forming apparatus includes the single photosensitive medium and the single exposing unit, and forms a full color toner image on an intermediate transfer medium by repeatedly performing a light exposing process, a developing process, and a transfer process for each of yellow, magenta, cyan, and black toner color images, such that the toner images are formed on the intermediate transfer medium in an overlapping manner. Then, the multi-pass type color image forming apparatus transfers the color toner image to a sheet of paper, and fuses the color toner image to the paper. Thus, a print speed of the multi-pass type color image forming apparatus is slower than that of the single-pass type color image forming apparatus, and color alignment is difficult.

To transfer toner having a specific polarity from each developing unit to a photosensitive medium, a development voltage of several hundreds volts to several thousands volts is applied to each developing unit.

FIG. 1 is a graph illustrating an example of a development voltage periodically applied to a developing roller in a conventional non-contact developing type image forming apparatus.

Referring to FIG. 1, a toner having a negative polarity is described as an example. A photosensitive medium is charged to a surface potential $V_o$ of −700 V by a charging device, and a portion where an image is formed (that is, a portion to which a toner is attached) is exposed by an exposing unit, and thus an electric potential at the portion is increased to an image potential $V_L$ of −100 V.

To attach the negative toner to the photosensitive medium, a development voltage $V_d$ of −1200 V is applied to a developing roller. The negative toner is jumped to the photosensitive medium from the developing roller due to a repulsive force against the development voltage $V_d$.

In this case, since a potential difference between the development voltage $V_d$ of the developing roller and the image potential $V_L$ of the photosensitive medium is larger than a potential difference between the development voltage $V_d$ and the surface voltage $V_o$, the negative toner is moved to only the exposed portion charged to the surface voltage $V_L$ and attaches thereto. However, some toner having a high electrical mobility among the negative toner may be attached to a non-exposed portion that is charged to the surface voltage $V_o$. Since the toner attached to the non-exposed portion causes an undesired image that results in contamination, the toner has to be removed from the non-exposed portion.

Generally, in a non-contact developing type image forming apparatus, a development voltage and a collection voltage are alternately applied to a developing roller. This is because a uniform image can be obtained by a repetitive movement of toners between the developing roller and the photosensitive medium since when the development voltage is directly applied without the collection voltage, it is difficult to attach toners uniformly to the photosensitive medium.

When a collection voltage $V_c$ of +300 V is applied to the developing roller, a negative toner attached to an exposed portion of the photosensitive medium does not move to the developing roller when a difference between the collection voltage $V_c$ and an image potential $V_L$ is smaller than a threshold potential Vth, but a negative toner attached to a non-exposed portion of the photosensitive medium moves to the developing roller since a potential difference (1000 V) between the collection voltage $V_c$ and a surface voltage $V_o$ is large. Consequently, the development voltage and the collecting voltage are alternately applied to the developing roller in a predetermined duty ratio, and thus the toner does not attach to the non-exposed portion of the photosensitive medium.

In such a conventional AC voltage applying method, since the total time period $t_0$ within which a development voltage $V_d$ and a collection voltage $V_c$ are applied is fixed, when the length of time that either the development voltage $V_d$ or the collection voltage $V_c$ is applied is increased, the length of time that the other voltage is applied is decreased, and thus a developing condition cannot be controlled.

Meanwhile, in an electric potential division developing method in which a tri-level potential is applied to a photosensitive medium and toners having a positive polarity and a negative polarity are simultaneously developed, toner can be attached to a non-image area, thus causing contamination. Specifically, when a development voltage is applied to a developing roller so that a negative polarity toner is attached to the photosensitive medium to which a positive polarity toner has already been attached, some of the positive polarity toner may move to the developing roller, or some of the negative polarity toner may attach to the positive polarity toner (having a polarity opposite to the negative polarity toner), which results in contamination.

SUMMARY OF THE INVENTION

The present general inventive concept provides an image forming apparatus to prevent cross contamination of toners having different polarities and colors by applying an intermediate voltage that does not affect the movement of toner to a developing unit.

The present general inventive concept also provides an AC voltage applying type image forming apparatus to freely control a developing condition.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus, including a plurality of developing units to form a color image using at least a two pass developing process by developing a plurality of electrostatic latent images with toners having different colors and polarities during a first pass of the developing process, an exposing unit to form a tri-level potential on a photosensitive medium, and a control unit to control one of a development voltage applied time and a collection voltage applied time without changing the other of the development voltage applied time and the collection voltage applied time by applying a development applied voltage to at least one of the plurality of developing units operating during the first pass of the developing process, by dividing the development applied voltage into a development voltage, a collection voltage, and at least one intermediate voltage, and by selectively applying the intermediate voltage to the at least one of the developing units during a time period of the development voltage to the second developing unit or during a time period of the collection voltage to the second developing unit.

The foregoing and/or other aspects and utilities of the present general inventive concept may be achieved by providing an image forming apparatus, including an imaging member, a developing unit, a power supply to generate a development applied voltage, and a controller to control the power supply to supply the developing unit with the development applied voltage having a first voltage for a first length of time to move toner from the developing unit to the imaging member during a first time period, a second voltage for a second length of time to move a portion of the toner from the imaging member to the developing unit during a second time period, and a third voltage between the first and second voltages for a third length of time during the first time period or the second time period.

The third voltage can be applied to the developing unit during the first time period, and the first voltage is not supplied during the application of the third voltage. The third length of time can be shorter than the first length of time. The third length of time can be longer than the first length of time. The third length of time can be approximately equal to the first length of time. The third voltage can be below a threshold voltage necessary to move the toner from the developing unit to the imaging member. The third voltage can be applied to the development unit during the second time period, and the second voltage is not supplied during the application of the third voltage. The third length of time can be shorter than the second length of time. The third length of time can be longer than the second length of time. The third length of time can be approximately equal to the second length of time. The third voltage can be below a threshold voltage necessary to move the toner from the imaging member to the developing unit. The first length of time can be shorter than the second length of time. The first length of time can be longer than the second length of time. The first length of time can be approximately equal to the second length of time. A sum of a length of the first time period and a length of the second time period can be constant.

The controller can control the power supply to supply the developing unit with the development applied voltage having a fourth voltage between the first and second voltages for a fourth length of time during the same time period as the third voltage. The third voltage and the fourth voltage can be applied to the developing unit during the first time period, and the first voltage may not be supplied during the application of the third voltage or the fourth voltage. The third voltage and the fourth voltage can be applied to the developing unit during the second time period, and the second voltage may not be supplied during the application of the third voltage or the fourth voltage. The controller can control the power supply to supply the developing unit with the development applied voltage having a fourth voltage between the first and second voltages for a fourth length of time during a different time period from the third voltage.

The foregoing and/or other aspects and utilities of the present general inventive concept may be achieved by providing an image forming apparatus, including a photosensitive drum, a first developing unit to develop a first image of the photosensitive drum with a first toner having a first characteristic, a second developing unit to develop a second image of the photosensitive drum with a second toner having a second characteristic, a power supply to generate a first development applied voltage and a second development applied voltage, and a control unit to control the power supply to supply the first development unit with a first development voltage, a first collection voltage, and a first intermediate voltage as the first development applied voltage, and to supply the second developing unit with a second development voltage, a second collection voltage, and a second intermediate voltage as the second development applied voltage.

The foregoing and/or other aspects and utilities of the present general inventive concept may be achieved by providing a method of controlling a voltage of a developing unit of an image forming apparatus, including supplying the developing unit with a development applied voltage having a first voltage for a first length of time to move toner from the developing unit to an imaging member of the image forming apparatus during a first time period, a second voltage for a second length of time to move a portion of the toner from the imaging member to the developing unit during a second time period, and a third voltage between the first and second voltages for a third length of time during the first time period or the second time period.

The third voltage can be applied to the developing unit during the first time period, and the first voltage may not be supplied during the application of the third voltage. The third voltage can be applied to the development unit during the second time period, and the second voltage may not be supplied during the application of the third voltage. The development applied voltage can further include a fourth voltage between the first and second voltages for a fourth length of time during the same time period as the third voltage. The third voltage and the fourth voltage can be applied to the developing unit during the first time period, and the first voltage may not be supplied during the application of the third voltage or the fourth voltage. The third voltage and the fourth voltage can be applied to the developing unit during the second time period, and the second voltage may not be supplied during the application of the third voltage or the fourth voltage. The development applied voltage can further include the fourth voltage between the first and second voltages for the fourth length of time during a different time period from the third voltage.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
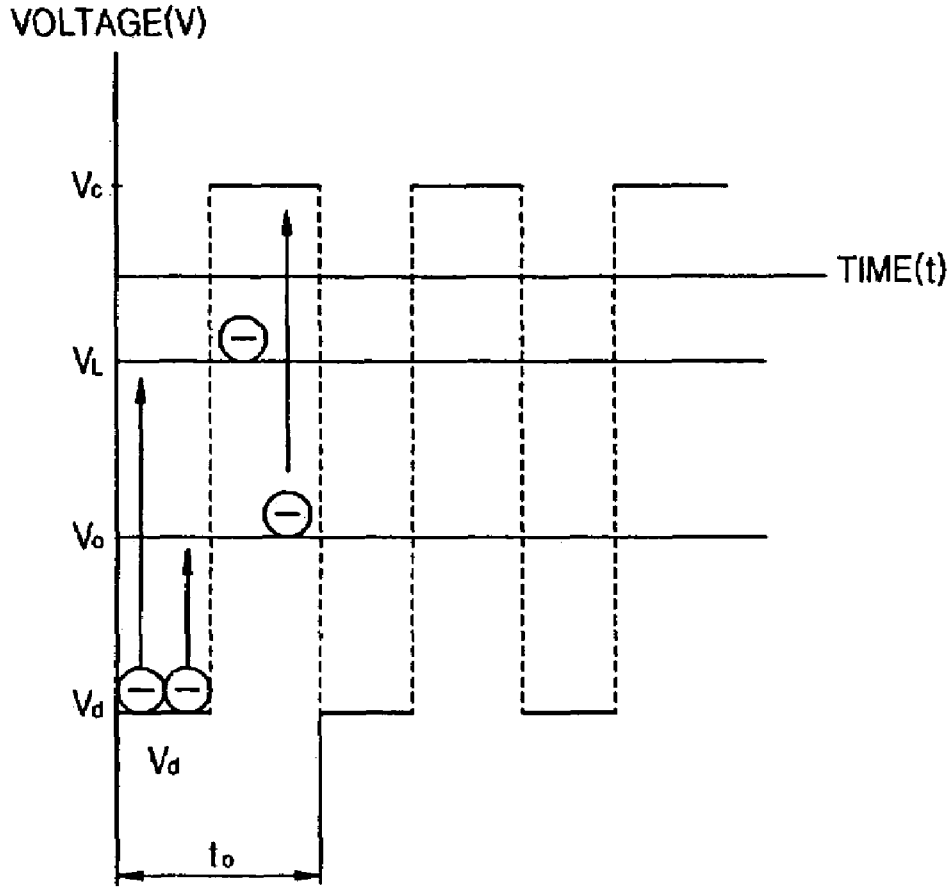
FIG. 1 (PRIOR ART)
FIG. 1 is a graph illustrating an example of a development voltage periodically applied to a developing roller of a conventional non-contact developing type image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
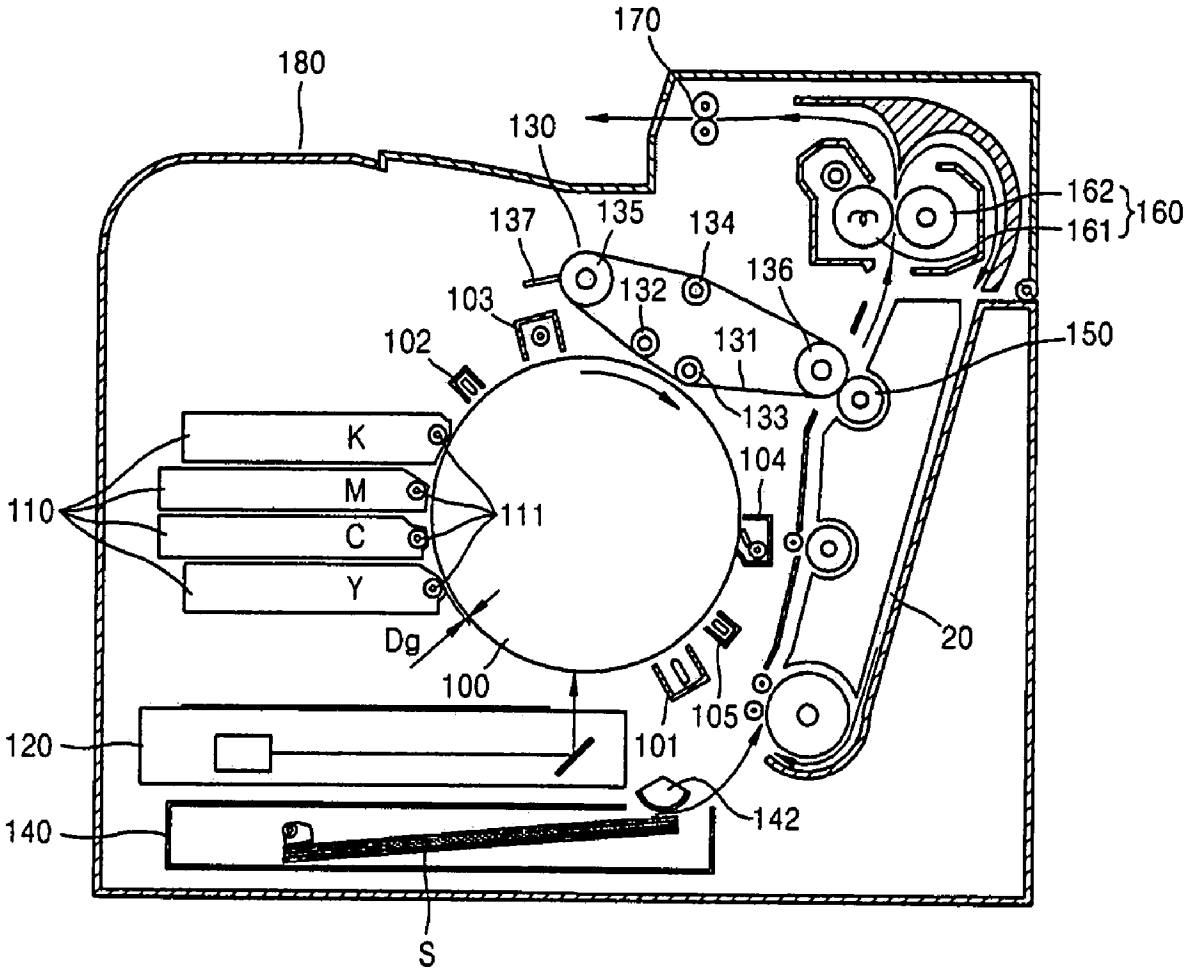
FIG. 2 is a cross-sectional view illustrating an image forming apparatus according to an embodiment of the present general inventive concept.

FIG. 2 is a cross-sectional view illustrating an image forming apparatus according to an embodiment of the present general inventive concept. Referring to FIG. 2, the image forming apparatus includes a photosensitive medium 100, a plurality of developing units 110, an exposing unit 120, an intermediate transfer unit 130, a feeding cassette 140, a transfer roller 150, a fuser 160, and a discharger 170.

The photosensitive medium 100 can be a photosensitive cylindrically shaped metal drum of which an outer surface is coated with a photoconductive layer. Hereinafter, the photosensitive medium 100 will be referred to as a photosensitive drum 100. However, the photosensitive medium 100 is not limited to being a photosensitive drum.

A charging device 101, a pre-transfer eraser 102, a charging unit 103, a photosensitive drum cleaning unit 104, and a pre-charge eraser 105 are installed around the photosensitive drum 100.

The charging device 101 charges the photosensitive drum 100 to a uniform electric potential and may include a charging roller or a corona charger. The charging device 101 provides the outer surface of the photosensitive drum 100 with electric charges while rotating in contact with or separate from the outer surface of the photosensitive drum 100 so that the outer surface of the photosensitive drum 100 is charged to the uniform electric potential.

The pre-transfer eraser 102 removes electric charges on a portion (non-image area) of the photosensitive drum 100 remaining after a toner image is formed on a predetermined portion (image area) of the photosensitive drum 100 and before the toner image on the photosensitive drum 100 is transferred to an intermediate belt 131. The pre-transfer eraser 102 can be selectively used as needed or desired.

The charging unit 103 charges toners having different polarities and colors to make their polarities identical with each other in order to transfer the toner image developed on the photosensitive drum 100 to the intermediate transfer unit 130.

The photosensitive drum-cleaning unit 104, which may be, for example, a cleaning blade, removes toner images that are not transferred to the intermediate transfer unit 130 from the photosensitive drum 100 and remain on the photosensitive drum 100.

The pre-charge eraser 105 removes electric charges on an entire surface of the photosensitive drum 100 before the toner image is formed on the photosensitive drum 100.

The plurality of developing units 110 includes yellow (Y), cyan (C), magenta (M), and black (K) color toners in solid powder form, respectively, and are arranged in a rotation direction facing the photosensitive drum 100. Each of the developing units 110 includes a developing roller 111 to form a toner image by providing toner to an electrostatic latent image formed on the photosensitive drum 100. The developing units 110 use a non-contact developing method in which the developing rollers 111 are installed apart from the outer surface of the photosensitive drum 110 by a developing gap Dg. The developing gap Dg may, for example, range from several tens of microns to hundreds of microns.

The exposing unit 120 is installed below the photosensitive drum 100 and forms an electrostatic latent image by scanning light to the photosensitive drum 100 that has been charged to a uniform electric potential by the charging device 101.

The intermediate transfer unit 130 can include the transfer belt 131, and a plurality of supporting rollers 132, 133, 134, 135, and 136 that support and rotate the transfer belt 131. The transfer belt 131 is interposed between the photosensitive drum 100 and the supporting rollers 132 and 133, and thus the toner image can be transferred to the transfer belt 131 from the photosensitive drum 100.

Furthermore, to remove waste toner remaining on the transfer belt 131 after the toner image is transferred to a printing medium, such as a sheet of paper S, the intermediate transfer unit 130 includes a cleaning member 137, which may be a cleaning blade, to scrape the waste toner by contacting a surface of the transfer belt 131. The supporting roller 136 is disposed to face the transfer roller 150 such that the transfer belt 131 is interposed between the supporting roller 136 and the transfer roller 150.

A rotation speed of the transfer belt 131 may be the same as a rotation speed of the photosensitive drum 100. The transfer belt 131 should be at least as long as a length of the paper S on which a color toner image is eventually formed.

The transfer roller 150 is installed to face the transfer belt 131 and be separated from the transfer belt 131 while a color toner image is transferred to the transfer belt 131 from the photosensitive drum 100, and to contact the transfer belt 131 with a predetermined pressure to transfer the color toner image to the paper S after the color toner image is completely formed on the transfer belt 131.

The fuser 160 can include a heating roller 161 and a pressurizing roller 162 that is installed opposite to the heating roller 161 to force the paper S towards the heating roller 161 with a predetermined pressure while rotating, and fuses the color toner image to the paper S by applying heat and pressure. Another heating roller can be used instead of the pressurizing roller 162. Furthermore, the fuser 160 is not limited to the heating roller 161 and/or to the pressurizing roller 162 illustrated in FIG. 2, and thus can be any suitable fixing device to fix the color toner image to the printing medium using heat and pressure.

The discharger 170 can include a pair of rollers to discharge the paper S on which the color toner image has been fused. The paper S discharged by the discharger 170 is stacked in a paper stacking tray 180.

The cassette 140 contains sheets of paper S, and is detachably installed in a main body of the image forming apparatus. A pickup roller 142 is installed above the cassette 140 in order to pick up the paper S one by one.

Reference numeral 20 denotes a duplex conveying portion through which the paper S, having the image printed on a first side, is returned to print another image on a second side of the paper S.

Since the image forming apparatus with the above structure may select a print mode from a plurality of print modes, such as a two-pass mode, a three-pass mode, and a four-pass mode, a user can select a desired print mode from the plurality of print modes in consideration of print speed and image quality.

For example, in the four-pass mode, electrostatic latent images are developed to single-color toner images using four color toners sequentially, and each color toner image is transferred to the transfer belt 131 in an overlapping manner to form a full-color image. A high quality image can be obtained using the four-pass mode.

In the two-pass mode, electric latent images formed on a photosensitive medium are developed using toners having different polarities and colors during a single developing process, and hence a desired color image can be formed by performing the single developing process only twice. In the two-pass mode, printing is performed at twice the speed of the four-pass mode.

In the three-pass mode, which is modified from the two-pass mode, toners having different polarities and colors that have been provided during a first pass are provided again to electrostatic latent images during a second pass, and toners having colors different from the colors of the toners provided in the first pass are provided to an electrostatic latent image during a third pass to form a color image, thereby performing the developing process three times. The three-pass mode has a print speed 30% higher than that of the four-pass mode, and provides enhanced image quality compared to the two-pass mode.

Figure 3:
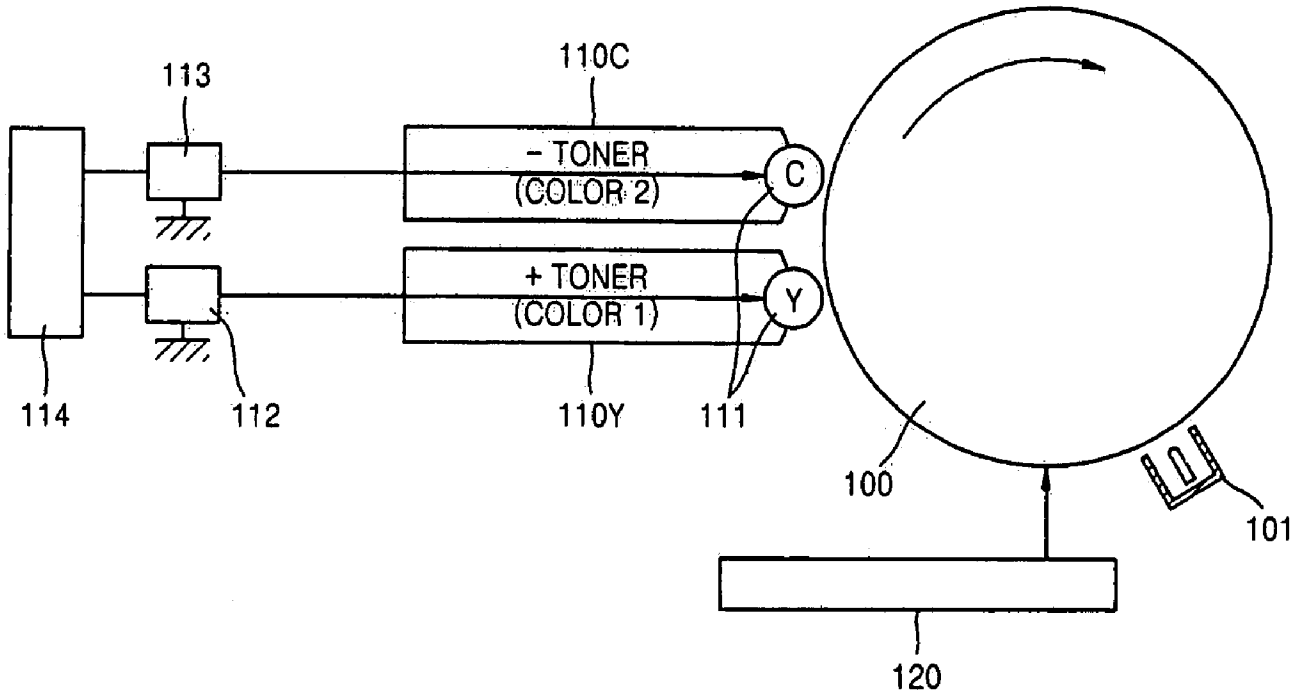
FIG. 3 is a view illustrating a structure to control development applied voltages applied to two developing units according to an embodiment of the present general inventive concept.
Figure 4:
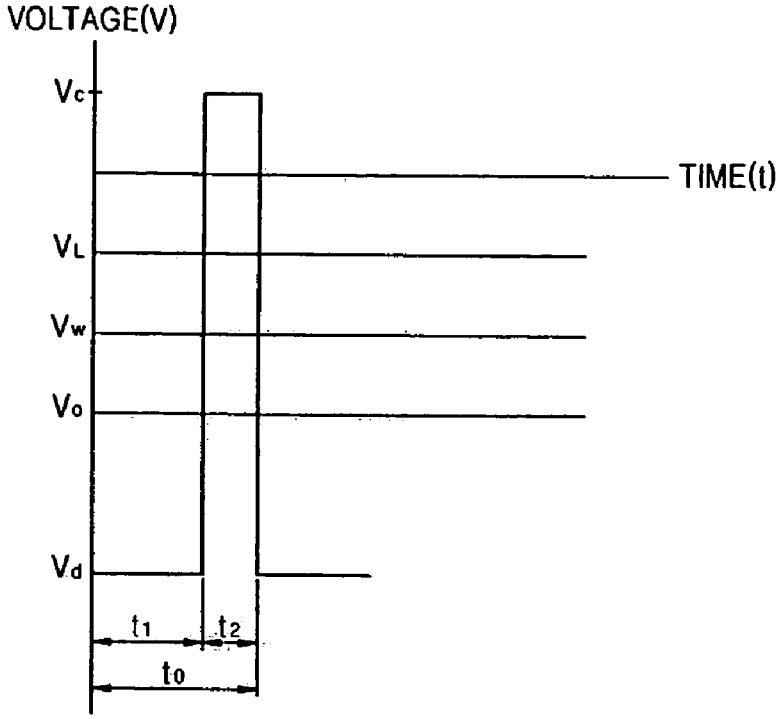
FIG. 4 is a graph illustrating distribution of a development applied voltage applied to a first developing unit of FIG. 3 according to an embodiment of the present general inventive concept.

FIG. 3 illustrates a structure to control development applied voltages applied to two developing units in a two-pass mode according to an embodiment of the present general inventive concept. FIG. 4 is a graph illustrating distribution of the development applied voltages applied to the developing units of FIG. 3 according to an embodiment of the present general inventive concept. A "development applied voltage" is a combination of a development voltage and a collection voltage alternately applied to a developing unit.

Referring to FIGS. 3 and 4, each development applied voltage of the developing units is controlled such that the two developing units develop a plurality of electric latent images formed on a photosensitive medium using toners with different polarities and colors during one developing process.

The photosensitive drum 100 is charged to a tri-level potential by the exposing unit 120. The tri-level potential includes a surface voltage Vo, a non-latent image potential $V_w$, and a latent image potential $V_L$. The surface voltage $V_o$ is formed on a surface of the photosensitive drum 100 by the charging device 101 and corresponds to a non-exposed portion, the non-latent image potential $V_w$ corresponds to a portion that is exposed to light by the exposing unit 120 but on which an image is not formed, and the latent image potential $V_L$ corresponds to a portion that is exposed to light by the exposing unit 120 and on which an image is formed. The relationship between the potentials may satisfy the following equation:

$$|\text{surface voltage } V_o| > |\text{non-latent image potential } V_w| > |\text{latent image potential } V_L|.$$

A developing unit 110Y containing a positive (+) yellow toner and a developing unit 110C containing a negative (−) cyan toner are sequentially arranged along a rotating direction of the photosensitive drum 100. The developing units 110Y and 110C are connected to power supplies 112 and 113, respectively, and a control unit 114 is connected to the power supplies 112 and 113 to control the development applied voltages of the developing units 110Y and 110C.

When the photosensitive drum 100 is charged to the tri-level potential, to move the positive (+) yellow toner from the developing unit 110Y to the photosensitive drum 100, the control unit 114 applies the development applied voltage to the developing unit 110Y The development applied voltage is formed by a development voltage $V_d$ and a collection voltage $V_c$, and the development voltage $V_d$ and the collection voltage $V_c$ are alternately applied to the developing unit 110Y. At this time, a positive toner is moved from the developing unit 110Y to a non-exposed portion of the photosensitive drum 100 charged to the surface voltage $V_o$ when the collection voltage $V_c$ is applied to the developing unit 110Y. Furthermore, the positive toner is collected on the developing unit 110Y when the development voltage $V_d$ is applied to the developing unit 110Y, opposite to the application and collection of the negative toner in FIG. 1. In this case of the positive toner, the collection voltage $V_c$ may be called the development voltage $V_d$, and the development voltage $V_d$ may be called the collection voltage $V_c$.

Referring to FIG. 4, when a time period within which the development voltage $V_d$ is applied to the developing unit 110Y is denoted by t1, a time period within which the collection voltage $V_c$ is applied to the developing unit 110Y is denoted by t2, and a total time period within which the development voltage $V_d$ and the collection voltage $V_c$ are applied to the developing unit 110Y (i.e., a fixed time period within which the development applied voltage is applied to the developing unit 110Y) is denoted by t0, t0=t1+t2. Furthermore, as illustrated in FIG. 4, t1 can be greater than t2. Alternatively, in embodiments of the present general inventive concept, t1 can be less than or equal to t2.

While the collection voltage $V_c$ is applied to the developing unit 110Y, the positive yellow toner is attached to the non-exposed portion of the photosensitive drum 100, which is charged to the surface voltage $V_o$, due to a difference of electrostatic force between the developing unit 110Y and the non-exposed portion of the photosensitive drum 100, according to electrostatic principles. When the development voltage $V_d$ is applied to the developing unit 110Y, toners that may be attached to portions of the photosensitive drum 100 other than the non-exposed portion are moved to the developing unit 110Y in order to be collected. Thus, the positive yellow toner is moved to the non-exposed portion of the photosensitive drum 100 so that the electrostatic latent image is developed while the photosensitive drum 100 passes by the developing unit 110Y.

Then, to move the negative (−) cyan toner from the developing unit 110C to the photosensitive drum 100, the control unit 114 applies the development applied voltage to the developing unit 110C. The development applied voltage includes a development voltage $V_d$, at least one intermediate voltage $V_n$ (see FIGS. 5-7), and a collection voltage $V_c$.

When a length of time to apply the intermediate voltage $V_n$ (which does not affect the development or collection of toner) during one cycle is changed, a developing voltage applied time or collecting voltage applied time can be more delicately controlled. In particular, the intermediate voltage $V_n$ can be applied either during the time period within which the development voltage is applied (for example, during the time period $t_1$ in FIG. 4), or during the time period within which the collection voltage is applied (for example, during the time period $t_2$ in FIG. 4). In this way, a length of time that one of the development voltage and the collection voltage is applied can be controlled without affecting a length of time that the other of the development voltage and the collection voltage is applied. For example, when the intermediate voltage $V_n$ is applied during the time period within which the development voltage is applied, the length of time that the development voltage is actually applied to the development unit is decreased. However, the length of time that the collection voltage is applied to the development unit remains unchanged. Similarly, when the intermediate voltage $V_n$ is applied during the time period within which the collection voltage is applied, the length of time that the collection voltage is actually applied to the development unit is decreased. However, the length of time that the development voltage is applied to the development unit remains unchanged.

Figure 8:
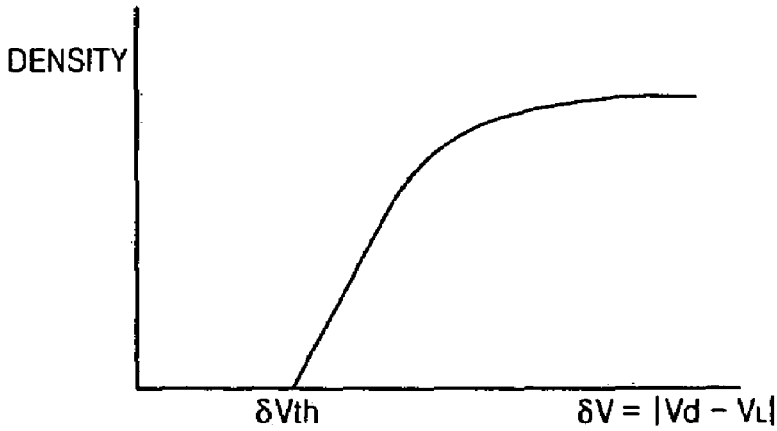
FIG. 8 is a graph illustrating a relationship between a development voltage and an image density according to an embodiment of the present general inventive concept.

Referring to FIG. 8, a development voltage greater than a development threshold potential σVth, that is, greater than a minimum potential required to move negative(−) toner from a developing roller to a photosensitive drum, has to be applied to the developing roller to move the negative(−) toner from the developing roller to the photosensitive drum. When the development voltage applied to the developing roller is equal to or less than the development threshold potential σVth, the negative(−) toner is not moved from the developing roller to the photosensitive drum. Thus, the intermediate voltage $V_n$ can be determined based on its relationship with the development threshold potential σVth or the non-latent image potential $V_w$. In particular, the intermediate voltage $V_n$ can be less than or equal to the development threshold potential σ Vth, such that when the intermediate voltage $V_n$ is applied during the time period within which the development voltage is applied, the length of time that the development voltage (which is greater than the development threshold potential σ Vth) is actually applied to the development unit is decreased. In other words, a length of time that the development voltage necessary to move the negative(−) toner from the developing roller to the photosensitive drum is decreased without increasing a length of time that the collection voltage is applied.

A development voltage may be applied for a shorter time period that of a collection voltage because if the development voltage is excessively applied, toner may be moved to both the image portion and the non-image portion, due to the toner's typical properties, resulting in a contaminated image.

In a developing system in which a toner is charged by friction, a predetermined amount of toner having a reverse polarity may be produced during a friction charging process. Such a toner having a reverse polarity is moved to a portion where another color toner is developed, and causes image contamination. Therefore, to control the movement of the toner having a reverse polarity (which is a cause of the image contamination) in the case of a negative toner, a time for which a collection voltage (which is a development voltage from the point of view of a reverse polarity toner) is applied to a developing unit is reduced.

However, conventionally, when the length of time that the collection voltage is actually applied is reduced, the length of time that the development voltage is actually applied is increased, and thus it is difficult to control the development voltage to obtain a desired image. To avoid this problem, according to embodiments of the present general inventive concept, at least an intermediate voltage $V_n$ that does not affect the movement of toner is employed, and consequently the length of time that the collection voltage is actually applied is relatively reduced without increasing the length of time that the developing voltage is applied. At this time, the total time period within which the development voltage and the collection voltage are applied is constant.

Moreover, conventionally, when it is desired that toner consumption be reduced by preventing excessive toner development even when the use of reverse polarity toner is minimized, if the length of time that the development voltage is applied is reduced, the length of time that the collection voltage is applied is increased, thereby doubly controlling the development. This may led to reduced image density. However, according to embodiments of the present general inventive concept, the length of time that the development voltage is actually applied can be independently reduced (i.e., the length of time that the development voltage is applied may be reduced independently from the length of time that the collection voltage is actually applied) by employing the intermediate voltage during the time period in which the development voltage is applied.

A method of controlling a length of time that a collection voltage $V_c$ is actually applied to a developing unit by applying an intermediate voltage $V_n$ to the developing unit during a time period of an application of the collection voltage $V_c$ according to embodiments of the present general inventive concept is described below. In this method, a total time period during which the collection voltage $V_c$ is applied is fixed, and the intermediate voltage $V_n$ is applied to the developing unit during this time period. Consequently, the length of time that the collection voltage $V_c$ is actually applied is reduced relative to the length of time that the intermediate voltage $V_n$ is applied.

A method of controlling a length of time that the development voltage $V_d$ is actually applied by applying the intermediate voltage $V_n$ during a time period of an application of the development voltage $V_d$ is similar to that described for controlling the length of time that the collection voltage $V_c$ is actually applied, and thus the detailed description thereof is not included. However, while the length of time that the collection voltage is actually applied to a developing unit is controlled, independent of the length of time that the development voltage is actually applied, by applying an intermediate voltage to the developing unit during a time period of application of the collection voltage according to various embodiments of the present general inventive concept, the length of time that the development voltage is actually applied to a developing unit can similarly be controlled, independent of the length of time that the collection voltage is actually applied, by applying an intermediate voltage to the developing unit during a time period of application of the development voltage according to various other embodiments of the present general inventive concept.

Figure 5:
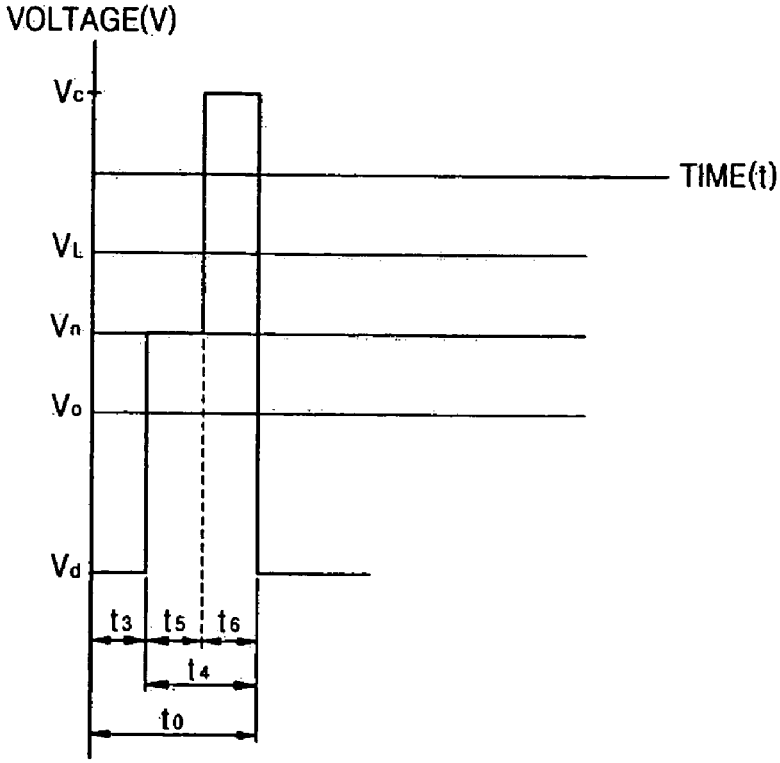
FIG. 5 is a graph illustrating distribution of a development applied voltage applied to a second developing unit of FIG. 3 according to an embodiment of the present general inventive concept.

FIG. 5 is a graph illustrating distribution of a development applied voltage applied to a second developing unit of FIG. 3 according to an embodiment of the present general inventive concept. Referring to FIG. 5, when a time during which a development voltage $V_d$ is applied is denoted by $t_3$, a total time period during which a collection voltage $V_c$ can be applied is denoted by $t_4$, and a total time period during which the development voltage $V_d$ and the collection voltage $V_c$ are applied is denoted by $t_0$, such that $t_0=t_3+t_4$ and $t_3<t_4$. In this case, $t_0$ is the same as the sum of $t_1$ and $t_2$ illustrated in FIG. 4.

$t_4$ is the sum of a length of time $t_5$ that an intermediate voltage $V_n$ is actually applied to the developing unit and a length of time $t_6$ that the collection voltage $V_c$ is actually applied to the developing unit. Thus, because the time period $t_4$ during which the collection voltage $V_c$ can be applied is fixed, the length of time $t_6$ (during which the collection voltage $V_c$ is actually applied) is relatively decreased by an increase in the length of time $t_5$ (during which the intermediate voltage $V_n$ is actually applied).

When the intermediate voltage is $V_n$, a non-latent image potential of the photosensitive drum is $V_w$, and a development threshold voltage difference is σ Vth, the relationship therebetween may satisfy formulas of:

$$(V_w-\sigma\,Vth)<V_n<(V_w+\sigma\,Vth) \quad (1), \text{ and}$$

$$V_n=V_w \quad (2).$$

Meanwhile, a developing process is performed using a non-contact method, and the non-latent image potential $V_w$ of the photosensitive drum is identical to the surface voltage $V_o$.

Figure 6:
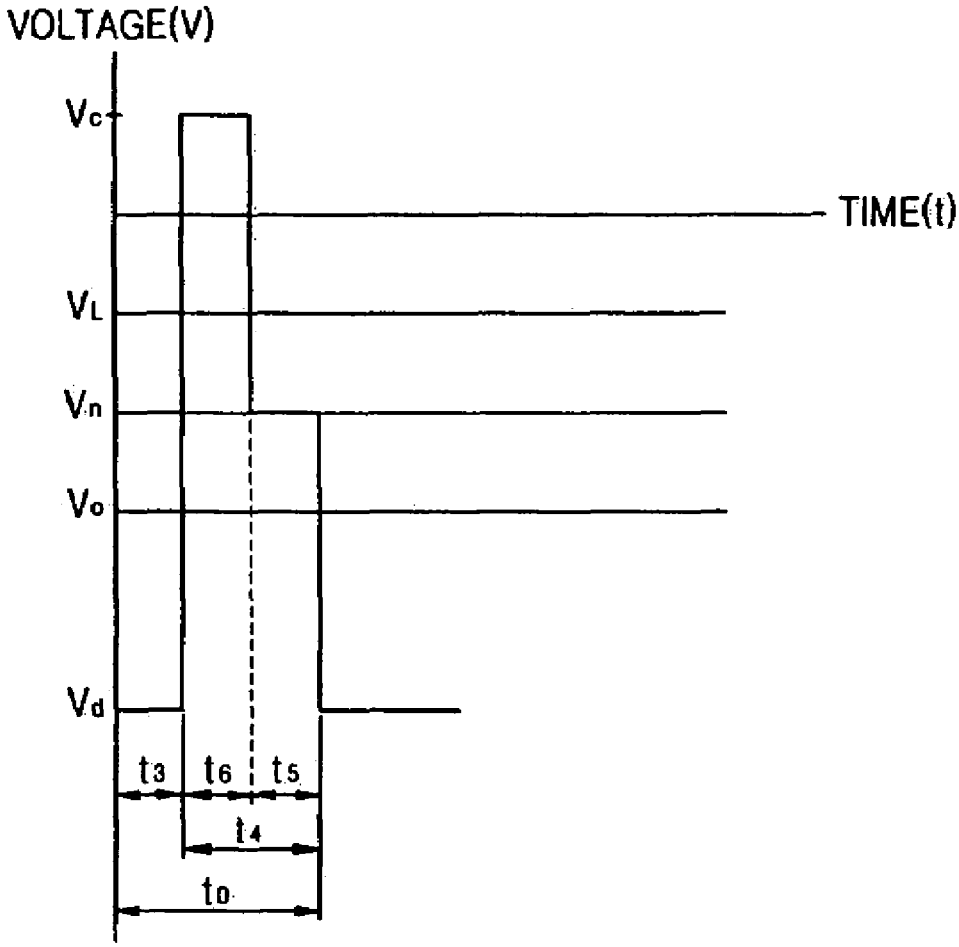
FIG. 6 is a graph illustrating another distribution of a development applied voltage applied to the second developing unit of FIG. 3 according to an embodiment of the present general inventive concept.

FIG. 6 is a graph illustrating another distribution of a development applied voltage applied to the second developing unit of FIG. 3 according to an embodiment of the present general inventive concept. Referring to FIG. 6, a length of time $t_6$ that a collection voltage $V_c$ is actually applied, a length of time t5 that an intermediate voltage $V_n$ is applied, and a total time period $t_4$ that is the sum of $t_6$ and $t_5$ are the same as the times $t_6$, $t_5$ and $t_4$ illustrated in FIG. 5, respectively. In FIG. 6, only the order of applying the collection voltage $V_c$ and the intermediate voltage $V_n$ is changed.

When the time period during which a development voltage $V_d$ is applied to the developing unit is $t_3$, the time period during which the collection voltage $V_c$ can be applied is t4 and a total time period during which the development voltage $V_d$ and the collection voltage $V_c$ are applied is $t_0$, it is desirable that $t_0=t_3+t_4$, and $t_3<t_4$. $t_0$ is the same as the sum of $t_1$ and $t_2$ illustrated in FIG. 4.

Figure 7:
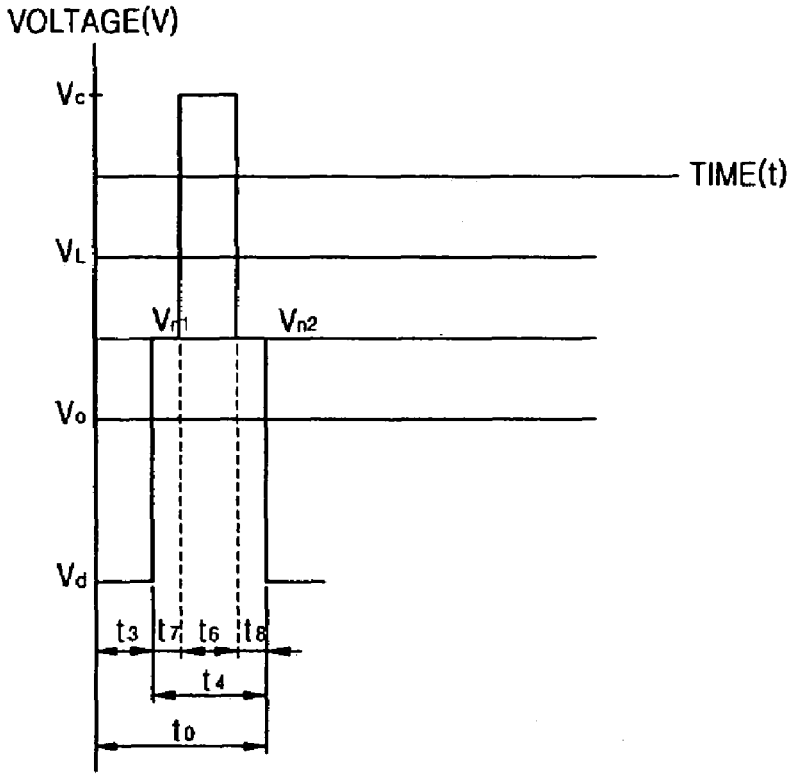
FIG. 7 is a graph illustrating another distribution of a development applied voltage applied to the second developing unit of FIG. 3 according to an embodiment of the present general inventive concept.

FIG. 7 is a graph illustrating another distribution of a development applied voltage applied to the second developing unit of FIG. 3 according to an embodiment of the present general inventive concept. Referring to FIG. 7, an intermediate voltage $V_n$ includes a first intermediate voltage $V_{n1}$ and a second intermediate voltage $V_{n2}$, and when a length of time that the first intermediate voltage $V_{n1}$ is applied to a developing unit is $t_7$ and a length of time that the second intermediate voltage $V_{n2}$ is $t_8$, a total length of time that the intermediate voltage $V_n$ is applied is the sum of $t_7+t_8$. That is, the length of time $t_5$ that the intermediate voltage $V_n$ is actually applied as illustrated in FIGS. 5 and 6 is the same as the sum of the length of time $t_7$ that the first intermediate voltage $V_{n1}$ is actually applied and the length of time $t_8$ that the second intermediate voltage $V_{n2}$ is actually applied.

A length of time $t_6$ that the collection voltage $V_c$ is actually applied, the length of time $t_5$ that the intermediate voltage $V_n$ is actually applied, and a total time period $t_4$ that is the sum of $t_6$ and $t_5$ are the same as $t_6$, $t_5$, and $t_4$ illustrated in FIG. 5, but there is a difference between FIG. 7 and FIG. 5 in that the first intermediate voltage $V_{n1}$ is applied before the collection voltage $V_c$ is applied, and the second intermediate voltage $V_{n2}$ is applied after the collection voltage $V_c$ is applied, to the developing unit.

When the time period during which the development voltage $V_d$ is applied is $t_3$, the time period during which the collection voltage $V_c$ can be applied is $t_4$ and the total time period during which the development voltage $V_d$ and the collection voltage $V_c$ are applied is t0, it is desirable that $t_0=t_3+t_4$ and $t_3<t_4$. In this case, $t_0$ is the same as the sum of $t_1$ and $t_2$ illustrated in FIG. 4.

Since $V_n=V_{n1}=V_{n2}$, where the intermediate voltage is $V_n$, as illustrated in FIG. 7, the first intermediate voltage $V_{n1}$ and the second intermediate voltage is $V_{n2}$, the first intermediate voltage $V_{n1}$ and the second intermediate voltage $V_{n2}$ may satisfy relations of Formulas 1 and 2 in place of the intermediate voltage $V_n$.

Using the above processes, while the photosensitive drum 100 passes by the developing unit 110C, an electrostatic latent image is formed by adhering a negative cyan toner to an exposed image portion that is charged to a latent image voltage $V_L$.

A portion charged to the surface voltage $V_o$ is developed by a positive yellow toner, an image area charged to the latent image voltage $V_L$ is developed by a negative cyan toner, and a non-image area charged to the non-latent image potential $V_w$ is not developed.

A plurality of toner images developed by toners having different colors and polarities are transferred from the photosensitive drum 100 to the transfer belt 131 by the force of attraction due to the opposite polarity. Specifically, when a negative voltage is applied to the transfer belt 131, the toner image developed on the photosensitive drum 100 is positively polarized.

However, since both the positive toner images and the negative toner images are present on the photosensitive drum 100, the positive toner images are transferred to the transfer belt 131 from the photosensitive drum 100, but the negative toner images are not transferred in this manner.

For this reason, a corona discharge is generated by applying a positive voltage from the charging unit 103 and a predetermined size of current is made to flow to the photosensitive drum 100 so that the toners having different polarities are positively polarized. This process is known as toner unipolarization.

The positively polarized toners on the photosensitive drum 100 are transferred to the transfer belt 131 from the photosensitive drum 100 by applying a negative voltage to the intermediate transfer unit 130. Although the toners as described above are positively polarized, the toners may instead be negatively polarized.

When a first pass is completed, a second pass in which a magenta toner and a black toner are moved to the photosensitive drum 100 is performed by repeating processes identical to the first pass. After completing the second pass, a color image is formed on the transfer belt 131.

The color image is transferred to a sheet of paper S using the transfer roller 150, and then is fused to the paper S while passing through the fuser 160. The paper S on which the color image has been fused is discharged to outside of the image forming apparatus, and the color image forming operation is completed.

As described above, an image forming apparatus according to the present general inventive concept controls independently a time during which a collection voltage or development voltage is applied to a developing unit by applying at least one intermediate voltage that does not affect the movement of toner, and thus prevents cross contamination due to the toner.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a plurality of developing units to form a color image using at least a two pass developing process by developing a plurality of electrostatic latent images with toners having different colors and polarities during a first pass of the developing process;

an exposing unit to form a tri-level potential on a photosensitive medium; and a control unit to control one of a development voltage applied time and a collection voltage applied time without changing the other of the development voltage applied time and the collection voltage applied time by applying a development applied voltage to at least one of the plurality of developing units operating during the first pass of the developing process, by dividing the development applied voltage into a development voltage, a collection voltage, and at least one intermediate voltage, and by selectively applying the intermediate voltage to the at least one of the developing units during a time period of the development voltage or during a time period of the collection voltage to the second developing unit.

2. The image forming apparatus of claim 1, wherein when the intermediate voltage is $V_n$, a non-latent image potential of the photosensitive medium is $V_w$, and a development threshold voltage difference is δ Vth, the development applied voltage is controlled to satisfy the equation: $V_w-\delta Vth<V_n<V_w+\delta Vth$.

3. The image forming apparatus of claim 2, wherein when the intermediate voltage $V_n$ includes a first intermediate voltage $V_{n1}$ and a second intermediate voltage $V_{n2}$, the development applied voltage is controlled to satisfy the equation: $V_n=V_{n1}=V_{n2}$.

4. The image forming apparatus of claim 1, wherein when the intermediate voltage is $V_n$ and a non-latent potential of the photosensitive medium is $V_w$, the development applied voltage is controlled to satisfy the equation: $V_n=V_w$.

5. The image forming apparatus of claim 4, wherein when the intermediate voltage $V_n$ includes a first intermediate voltage $V_{n1}$ and a second intermediate voltage $V_{n2}$, the development applied voltage is controlled to satisfy the equation: $V_n=V_{n1}=V_{n2}$.

6. An image forming apparatus, comprising:

a plurality of developing units to develop electrostatic latent images using a non-contact developing method; and a control unit to control a development applied voltage applied to each of the developing units and to be divided into a development voltage $V_d$, a collection voltage $V_c$, and at least one intermediate voltage $V_n$, wherein the intermediate voltage $V_n$ is selectively applied to one of the plurality of developing units during a development voltage $V_d$ applied time during which the development voltage $V_d$ is applied to the developing unit or during a collection voltage $V_c$ applied time during which the collection voltage $V_c$ is applied to the developing unit to control one of the development voltage applied time and the collection voltage applied time without changing the other one of the development voltage $V_d$ applied time and the collection voltage $V_c$ applied time.

7. The image forming apparatus of claim 6, wherein when the intermediate voltage is $V_n$, a surface voltage of the photosensitive medium is $V_o$, and a development threshold voltage difference is δ Vth, the development applied voltage is controlled to satisfy the equation: $V_o-\delta Vtn<V_n<V_o+\delta Vth$.

8. The image forming apparatus of claim 7, wherein the development applied voltage is controlled to satisfy the equation: $V_n=V_o$.

9. The image forming apparatus of claim 7, wherein when the intermediate voltage $V_n$ includes a first intermediate voltage $V_{n1}$ and a second intermediate voltage $V_{n2}$, the development applied voltage is controlled to satisfy the equation: $V_n=V_{n1}=V_{n2}$.

10. The image forming apparatus of claim 6, wherein when the intermediate voltage is $V_n$ and a surface voltage of the photosensitive medium is $V_o$, the development applied voltage is controlled to satisfy the equation: $V_n=V_o$.

11. The image forming apparatus of claim 10, wherein when the intermediate voltage $V_n$ includes a first intermediate voltage $V_{n1}$ and a second intermediate voltage $V_{n2}$, the development applied voltage is controlled to satisfy the equation: $V_n=V_{n1}=V_{n2}$.

12. An image forming apparatus, comprising:

an imaging member;

a developing unit;

a power supply to generate a development applied voltage; and a controller to control the power supply to supply the developing unit with the development applied voltage having a first voltage for a first length of time to move toner from the developing unit to the imaging member during a first time period, a second voltage for a second length of time to move a portion of the toner from the imaging member to the developing unit during a second time period, and a third voltage between the first and second voltages for a third length of time during the first time period or the second time period, wherein the third voltage is substantially constant during the third length of time.

13. The image forming apparatus of claim 12, wherein the third voltage is applied to the developing unit during the first time period, and the first voltage is not supplied during the application of the third voltage.

14. The image forming apparatus of claim 13, wherein the third length of time is shorter than the first length of time.

15. The image forming apparatus of claim 13, wherein the third length of time is longer than the first length of time.

16. The image forming apparatus of claim 13, wherein the third length of time is approximately equal to the first length of time.

17. The image forming apparatus of claim 13, wherein the third voltage is below a threshold voltage necessary to move the toner from the developing unit to the imaging member.

18. The image forming apparatus of claim 13, wherein the first length of time is shorter than the second length of time.

19. The image forming apparatus of claim 12, wherein the third voltage is applied to the development unit during the second time period, and the second voltage is not supplied during the application of the third voltage.

20. The image forming apparatus of claim 19, wherein the third length of time is shorter than the second length of time.

21. The image forming apparatus of claim 19, wherein the third length of time is longer than the second length of time.

22. The image forming apparatus of claim 19, wherein the third length of time is approximately equal to the second length of time.

23. The image forming apparatus of claim 19, wherein the third voltage is below a threshold voltage necessary to move the toner from the imaging member to the developing unit.

24. The image forming apparatus of claim 12, wherein the first length of time is longer than the second length of time.

25. The image forming apparatus of claim 12, wherein the first length of time is approximately equal to the second length of time.

26. The image forming apparatus of claim 12, wherein a sum of a length of the first time period and a length of the second time period is constant.

27. The image forming apparatus of claim 12, wherein the controller controls the power supply to supply the developing unit with the development applied voltage having a fourth voltage between the first and second voltages for a fourth length of time during the same time period as the third voltage.

28. The image forming apparatus of claim 27, wherein the third voltage and the fourth voltage are applied to the developing unit during the first time period, and the first voltage is not supplied during the application of the third voltage or the fourth voltage.

29. The image forming apparatus of claim 28, wherein the third voltage is applied before the first voltage, and the fourth voltage is applied after the first voltage.

30. The image forming apparatus of claim 27, wherein the third voltage and the fourth voltage are applied to the developing unit during the second time period, and the second voltage is not supplied during the application of the third voltage or the fourth voltage.

31. The image forming apparatus of claim 30, wherein the third voltage is applied before the second voltage, and the fourth voltage is applied after the second voltage.

32. The image forming apparatus of claim 12, wherein the controller controls the power supply to supply the developing unit with the development applied voltage having a fourth voltage between the first and second voltages for a fourth length of time during a different time period from the third voltage.

33. The image forming apparatus of claim 12, wherein the second length of time follows the first length of time, and the third length of time follows the second length of time.

34. An image forming apparatus, comprising:

a photosensitive drum;

a first developing unit to develop a first image of the photosensitive drum with a first toner having a first characteristic;

a second developing unit to develop a second image of the photosensitive drum with a second toner having a second characteristic;

a power supply to generate a first development applied voltage and a second development applied voltage; and a control unit to control the power supply to supply the first development unit with a first development voltage, a first collection voltage, and a first intermediate voltage as the first development applied voltage, and to supply the second developing unit with a second development voltage, a second collection voltage, and a second intermediate voltage as the second development applied voltage, wherein the first and second intermediate voltages are substantially constant.

35. The apparatus of claim 34, wherein the first and second intermediate voltages do not substantially affect the movement of the toner between the developing unit and the imaging member.

36. A method of controlling a voltage of a developing unit of an image forming apparatus, comprising:

supplying the developing unit with a development applied voltage having a first voltage for a first length of time to move toner from the developing unit to an imaging member of the image forming apparatus during a first time period, a second voltage for a second length of time to move a portion of the toner from the imaging member to the developing unit during a second time period, and a third voltage between the first and second voltages for a third length of time during the first time period or the second time period, wherein the third voltage is substantially constant during the third length of time.

37. The method of claim 36, wherein the third voltage is applied to the developing unit during the first time period, and the first voltage is not supplied during the application of the third voltage.

38. The method of claim 36, wherein the third voltage is applied to the development unit during the second time period, and the second voltage is not supplied during the application of the third voltage.

39. The method of claim 36, wherein the development applied voltage further includes a fourth voltage between the first and second voltages for a fourth length of time during the same time period as the third voltage.

40. The method of claim 39, wherein the third voltage and the fourth voltage are applied to the developing unit during the first time period, and the first voltage is not supplied during the application of the third voltage or the fourth voltage.

41. The method of claim 40, wherein the third voltage is applied before the first voltage, and the fourth voltage is applied after the first voltage.

42. The method of claim 39, wherein the third voltage and the fourth voltage are applied to the developing unit during the second time period, and the second voltage is not supplied during the application of the third voltage or the fourth voltage.

43. The method of claim 42, wherein the third voltage is applied before the second voltage, and the fourth voltage is applied after the second voltage.

44. The method of claim 36, wherein the development applied voltage further includes a fourth voltage between the first and second voltages for a fourth length of time during a different time period from the third voltage.

45. The method of claim 36, wherein the third voltage does not substantially affect the movement of the toner between the developing unit and the imaging member.

* * * * *